US005395564A

United States Patent [19]

Frisbie et al.

[11] Patent Number: 5,395,564

[45] Date of Patent: Mar. 7, 1995

[54] METHOD FOR CONTROLLING THROUGHPUT

[75] Inventors: Elizabeth L. Frisbie, Brentwood; Stephen E. Moore, Goodlettsville; Lyles H. Sowell, Old Hickory, all of Tenn.

[73] Assignee: E. I. Du Pont de Nemours and Company, Wilmington, Del.

[21] Appl. No.: 151,617

[22] Filed: Nov. 15, 1993

[51] Int. Cl.[6] ..... D04H 1/72

[52] U.S. Cl. ..... 264/40.4; 264/40.7; 264/518

[58] Field of Search ..... 264/40.7, 40.4, 518

[56] References Cited

U.S. PATENT DOCUMENTS 4,557,882 12/1985 Arnold ..... 264/40.4
4,927,582 5/1990 Bryson ..... 264/113
5,102,585 4/1992 Pieper et al. ..... 264/37

*Primary Examiner*—Mary Lynn Theisen

[57] ABSTRACT

A rate control system to deliver a constant throughput for batt forming equipment that forms the batts by maintaining a pressure gradient across fibers deposited on a rotating condenser screen, the weight of a moving fiber batt is continuously measured as it passes over an inclined slide mounted on load cells. This measurement is converted electronically to a rate value which is then used with the pressure gradient signal to control the delivery of fiber to the condenser screen by adjusting the speed of the feed rolls used to feed the fiber to the condenser screen.

3 Claims, 1 Drawing Sheet

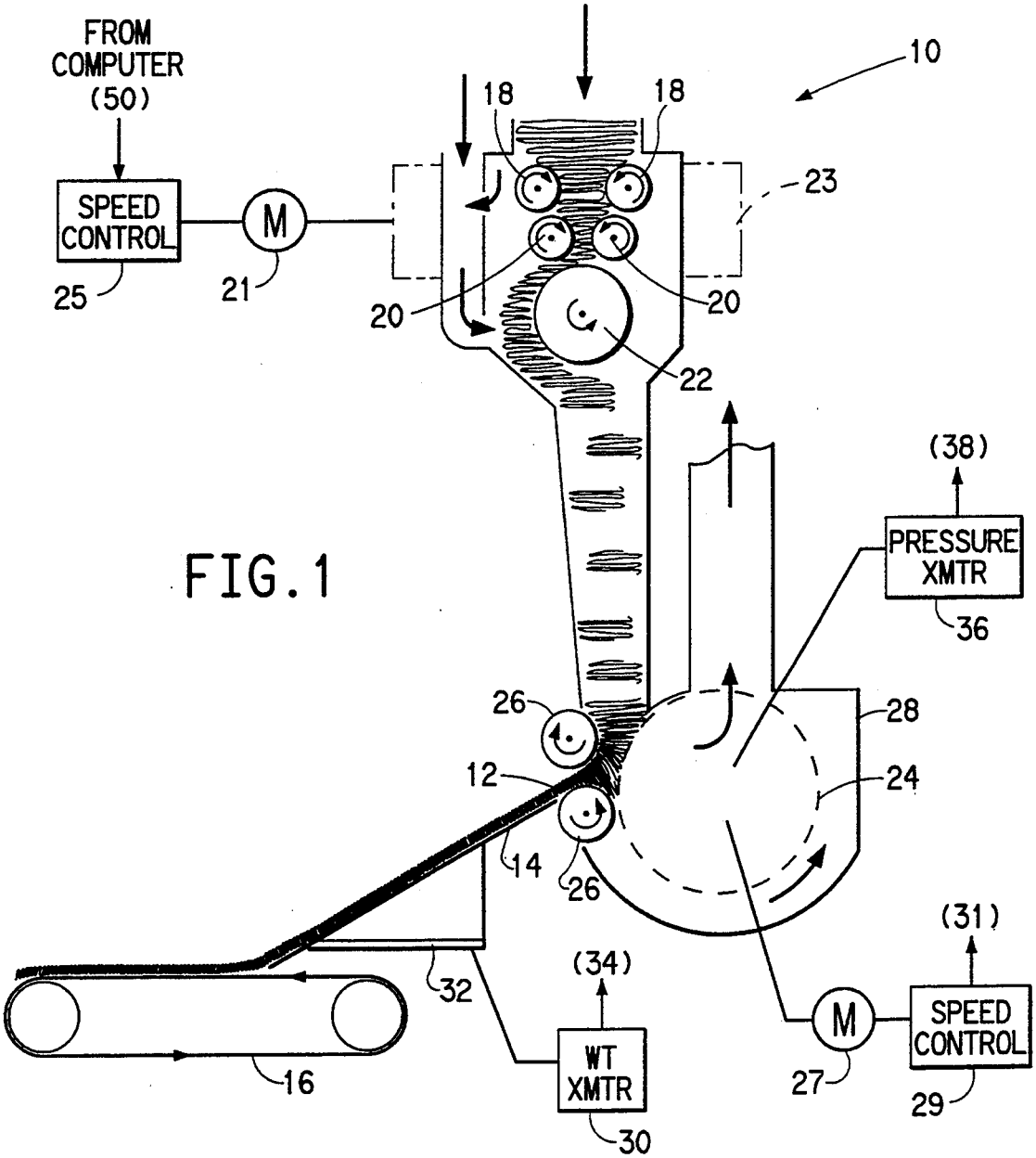
FIG. 1
FIG. 2
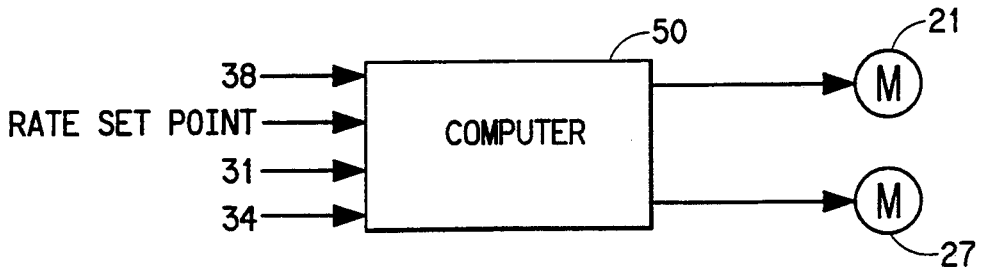

METHOD FOR CONTROLLING THROUGHPUT

BACKGROUND OF THE INVENTION

This invention relates to a method for controlling the uniformity of fiber batts exiting a batt forming apparatus more particularly, it relates to a method to control the throughput of fiber through the machine as a function of the weight of the batt and the pressure drop across the fiber on a rotating condenser screen.

Commercial apparatus for feeding staple fiber in the form of fiber batts to a moving belt (or the like) for further processing, such as Rando Machine Corporation's LEVELFEED, meters fiber into the batt being formed by controlling and maintaining an air pressure gradient across staple fiber being deposited on a rotating condenser screen operated at a fixed speed. This metering, based on an air pressure gradient across the forming fiber batt, was not as consistent as desired for the ultimate in downstream uniformity and variations in thickness and density could occur which resulted in downstream product being out of specification. This method of control combined with ever changing machine conditions, such as leaking seals, fiber hang-up, restrictions in air flow, resulted in the poorer than required fiber throughput control.

SUMMARY OF THE INVENTION

A method for controlling the throughput of fiber through a batt forming machine that includes driven feed rolls for delivering fiber to a rotating condenser screen under a negative pressure whereby the fiber is formed into a batt on the screen and then fed from the screen to an inclined slide scale for further processing wherein the throughput of the fiber is controlled as a function of a pressure drop across the batt on the screen and is improved by controlling the delivery of the fiber to the condenser screen as a function of both the pressure drop across the batt and the screen and the weight of the batt on the slide and by controlling the required condenser screen speed as an automatic function of the throughput.

BRIEF DESCRIPTION OF THE DRAWINGS

FIG. 1 is a schematic illustration of apparatus useful in practicing the invention.

FIG. 2 is a schematic illustration of the control system for the apparatus.

DETAILED DESCRIPTION OF THE ILLUSTRATED EMBODIMENT

Referring to FIG. 1, the apparatus chosen for purposes of illustration includes a batt forming machine 10 such as a RandoLevel Feed model 60, by Rando Machine Corporation, feeding a fiber batt 12 to inclined slide 14 onto belt conveyor 16. The batt forming machine 10 includes first stage feed rolls 18, second stage feed rolls 20, driven opening roll 22, a rotating condenser screen 24 driven by motor 27 controlled by speed controller 29 (via computer 50) which provides a signal 31 proportional to the speed of motor 27, driven delivery rolls 26, and a suction air manifold 28 surrounding condenser screen 24 places the screen under a negative pressure or suction. First and second stage feed rolls are driven by motor 21 through a gear box 23. Motor 21 is controlled by speed controller 25 via computer 50. A weight transmitter 30 is attached to inclined slide 14 to continuously weigh batt 12 on the slide by means of load cell 32 (i.e., a slide scale) and generate a signal 34 proportional thereto. A pressure transmitter 36 is associated with condenser screen 24 to sense the pressure drop across the batt 12 formed on the screen, and provides a signal 38 proportional to the pressure drop.

FIG. 2 illustrates the control system for the apparatus 10. More particularly, a computer 50 having four inputs, i.e., pressure signal 38, condenser screen speed 31, weight signal 34 and fiber feed rate set point provides control signals for motors 21 and 27.

The control components of the apparatus are commercially available items. Typical components are as follows:

| Element Number | Element Name | Commercial Identification |
|---|---|---|
| 32 | Load Cells | Model HI 1212PS-C10 10 lb. capacity, Hardy Instruments |
| 30 | Weight transmitter | Model H 2151 Hardy Instruments |
| 50 | Computer | Automax PLC System Reliance Electric Inc. |
| 36 | Condenser Pressure Transmitter | Model STD 120 Honeywell |

In operation the system functions as follows:

A. The desired rate setpoint in pounds per hour is entered into the computer from an external source based on production requirements.

B. The required condenser screen speed for the entered rate is calculated in the computer in an equation determined experimentally, with appropriate scaling constants.

$$\text{Speed}=K1*(K2*\text{Rate})+K3)$$

Where:

K1=0.006984=28.6/4095

4095=Maximum 12 bit resolution number 28.6=Maximum condenser screen speed in feet per minute (FPM)

K2=1.721=0.012019*(4095/28.6)

0.012019 was determined experimentally

K3=375=2.6227*(4095/28.6)

2.6227 was determined experimentally.

C. The condenser speed controller in the computer controls the condenser screen motor to achieve the required speed.

D. The computer generates a required condenser screen pressure setpoint based on the rate setpoint and the actual fiber feed rate.

E. The actual fiber feed rate is calculated in the computer in an equation based on the geometry of the incline slide, the weight signal (34) representing the actual weight of the fiber batt on the incline slide, and the actual condenser screen speed (31), with appropriate scaling constants.

$$\text{Rate}=K4*\text{Weight}*\text{Speed}$$

Where:

K4=31.311138=(1/23*271.39)* (4095/3*4095/28.6)

23=Length of incline slide 271.39=12 in/ft*60 min/hr*0.3769

0.3769=conversion factor determined experimentally

4095=maximum 12 bit resolution number

3=maximum weight signal in pounds 28.6=maximum condenser screen speed in FPM

F. The computer controls the feed rolls motor (21) speed varying the amount of fiber delivery to the condenser screen and the resultant condenser screen pressure (38) to achieve the required condenser screen pressure. The condenser screen pressure is a measurement that is predominantly the pressure drop across the fiber on the condenser screen.

What is claimed is:

1. In a method for controlling the throughput of fiber through a batt forming machine that includes driven feed rolls for delivery of fiber to a rotating condenser screen under a negative pressure whereby the fiber is formed into a batt on the condenser screen and then fed from the screen to a slide for further processing wherein the throughput of the fiber is controlled as a function of a pressure drop across the batt on the condenser screen the improvement comprising: controlling the delivery of the fiber to the condenser screen as a function of both the pressure drop across the batt on the screen and the weight of the batt on said slide.

2. The method of claim 1 wherein said slide is inclined slide scale.

3. The method of claim 3 wherein the condenser screen speed is automatically calculated as a function of throughput.

* * * * *